US011845642B2

(12) United States Patent
Ayhan et al.

(10) Patent No.: US 11,845,642 B2
(45) Date of Patent: Dec. 19, 2023

(54) METHOD FOR OPERATING A SYSTEM, AND SYSTEM

(71) Applicant: SEW-EURODRIVE GMBH & CO. KG, Bruchsal (DE)

(72) Inventors: Serdal Ayhan, Dielheim (DE); Andreas Wanjek, Waghäusel (DE); Zhidong Hua, Bruchsal (DE); Thomas Schäfer, Karlsdorf-Neuthard (DE); Josef Schmidt, Graben-Neudorf (DE)

(73) Assignee: SEW-EURODRIVE GMBH & CO.KG, Bruchsal (DE)

( * ) Notice: Subject to any disclaimer, the term of this patent is extended or adjusted under 35 U.S.C. 154(b) by 821 days.

(21) Appl. No.: 16/963,496

(22) PCT Filed: Dec. 13, 2018

(86) PCT No.: PCT/EP2018/025319
§ 371 (c)(1),
(2) Date: Jul. 20, 2020

(87) PCT Pub. No.: WO2019/141339
PCT Pub. Date: Jul. 25, 2019

(65) Prior Publication Data

US 2021/0047162 A1 Feb. 18, 2021

(30) Foreign Application Priority Data

Jan. 18, 2018 (DE) ..... 10 2018 000 365.6

(51) Int. Cl.
*B66F 9/06* (2006.01)
*B66F 9/075* (2006.01)

(52) U.S. Cl.
CPC ..... *B66F 9/063* (2013.01); *B66F 9/0755* (2013.01)

(58) Field of Classification Search
CPC ..... B66F 9/063
See application file for complete search history.

(56) References Cited

U.S. PATENT DOCUMENTS 8,917,321 B1 12/2014 Sasabuchi et al.
10,481,244 B2 11/2019 Malik
(Continued)

FOREIGN PATENT DOCUMENTS

CN 104040606 A 9/2014
CN 107076836 A 8/2017
(Continued)

OTHER PUBLICATIONS

Chinese Office Action issued in corresponding CN Application No. 201880086935, dated Aug. 4, 2021, pp. 1-7.

*Primary Examiner* — Michael A Berns
(74) *Attorney, Agent, or Firm* — CARTER, DELUCA & FARRELL LLP

(57) ABSTRACT

In a method for operating a system, and a system, the system includes a mobile part drivable on a driving surface, and a load carrier. The mobile part includes a radar sensor connected to a control of the mobile part. The frequency spectrum of an intermediate frequency signal is determined, and, using pattern recognition, the frequency spectrum is compared with stored pattern samples, and the result of the comparison is conveyed to the control. The control actuates actuators such as a drive and/or steering unit of the mobile part as a function of the result of the comparison.

23 Claims, 3 Drawing Sheets

(56) References Cited

U.S. PATENT DOCUMENTS

| | | | | |
|---|---|---|---|---|
| 2013/0302132 | A1* | 11/2013 | D'Andrea | G06Q 10/087<br>414/807 |
| 2021/0047162 | A1* | 2/2021 | Ayhan | B66F 9/0755 |

FOREIGN PATENT DOCUMENTS

| | | | |
|---|---|---|---|
| DE | 19540928 | A1 | 5/1997 |
| EP | 3132859 | A1 | 2/2017 |

* cited by examiner

METHOD FOR OPERATING A SYSTEM, AND SYSTEM

FIELD OF THE INVENTION

The present invention relates to a method for operating a system and to a system.

BACKGROUND INFORMATION

Certain logistical tasks in a system can be carried out with the aid of mobile parts such as driverless transport systems (DTS).

SUMMARY

Example embodiments of the present invention provide for making the workflow in the system more efficient.

According to example embodiments of the present invention, in a method for operating a system that has a mobile part, which is able to be driven on a driving surface of the system, and a load carrier, in particular a load carrier situated in the system in a stationary manner, in which the mobile part has a radar sensor, which is connected to a control of the mobile part, in a first method step, the distance from the radar sensor to the load carrier is determined; in a second method step, the mobile part is driven to a position in which the distance between the radar sensor and the load carrier reaches a predefined setpoint distance; in a third method step, the frequency spectrum of an intermediate frequency signal is determined, which is generated by mixing the radar radiation emitted by the radar sensor, in particular in the direction of the load carrier, and the received radar radiation, in particular from the direction of the load carrier; in a fourth method step, in particular using pattern recognition, the frequency spectrum, in particular the pattern produced by the frequency spectrum, is compared to stored pattern samples and the result of the comparison is conveyed to the control; and in a fifth method step, the control actuates actuators such as a drive and/or a steering unit of the mobile part as a function of the result, in particular, the control thus carries out a control sequence as a function of the result.

This has the advantage that the control lets different control sequences be carried out depending on the non-availability or the availability of the type of load carrier. Thus, for example, if no load carrier is detectable at the expected location, in particular a stacker store, the mobile part is able to stop and wait, for instance, or the mobile part may assume some other logistical task. However, if a wire-mesh crate is detected, for example, the wire-mesh crate may be picked up by the mobile part and the wire-mesh crate is then able to be taken to a different location. On the other hand, if a steel-walled box is identified, it is able to be accommodated on the mobile part. If a Euro pallet is identified, however, it is first assessed whether or not a load is situated on the Euro pallet. If no load is present, either a load transported by the mobile part is set down on the Euro pallet or the Euro pallet is picked up by the mobile part and transported to a different location.

According to example embodiments, the result of the comparison in the fourth method step is the type of load carrier. This offers the advantage that the type of load carrier, e.g., a Euro pallet with a load, a Euro pallet without a load, a wire-mesh crate or a steel-walled box, is able to be identified with the aid of the radar sensors. An image evaluation unit connected to a camera situated on the mobile part may be used as a matter of principle but is not required.

The mentioned image evaluation makes it possible to reduce the error susceptibility of the type detection based on radar sensors. However, the image evaluation unit requires computing time.

According to example embodiments, a first pattern sample is generated from the frequency spectrum of the intermediate frequency signal of the radar sensor during the detection of a wire-mesh crate, the wire-mesh crate in particular having a side wall provided with steel mesh whose mesh openings particularly have a maximum inner diameter of less than 5 cm, the wire-mesh crate in particular being arranged to be open at the top. This has the advantage that a wire-mesh crate is able to be identified despite having mesh openings so that that only parts of the surface reflect radar radiation.

According to example embodiments, a second pattern sample is generated from the frequency spectrum of the intermediate frequency signal of the radar sensor during the detection of a steel-walled box, the steel-walled box in particular having a side wall of solid steel, the steel-walled box in particular being open at the top. This offers the advantage that a strong reflection of radar radiation is induced and excellent identifiability is able to be achieved as a result.

According to example embodiments, a third pattern sample is generated from the frequency spectrum of the intermediate frequency signal of the radar sensor during the detection of a Euro pallet carrying a load, the Euro pallet in particular being made of wood and the load including a cardboard box. This has the advantage that a cardboard box which encloses the parts that are included in the load and which is situated on the Euro pallet made of wood, reflects only little radar radiation and is therefore easily distinguishable from a wire-mesh crate and also from a steel-walled box.

According to example embodiments, a fourth pattern sample is generated from the frequency spectrum of the intermediate frequency signal of the radar sensor during the detection of a Euro pallet without a load, the Euro pallet in particular being made from wood. This has the advantage that no reflection is generated from the expected distance due to the missing load, and the radar radiation instead is reflected by objects at a greater distance. This makes it possible to identify the absence of a load. However, the Euro pallet made of wood generates a reflected characteristic signal, which is able to be identified. As a result, even a Euro pallet without a load is identifiable.

According to example embodiments of the present invention, in particular a system for carrying out a previously mentioned method, the system has a mobile part which is able to be driven on a driving surface of the system, and it has a load carrier which is situated in the system, in particular on the driving surface, the mobile part has a control, an electric drive which is controllable with the aid of the control, and a controllable steering unit. A radar sensor is situated on the mobile part, the radar sensor is connected to the control disposed on the mobile part for a signal transmission, and the control controls the drive and the steering unit as a function of the signals from the radar sensor.

This has the advantage that a respective control sequence is able to be carried out as a function of the identified type of load carrier. More specifically, wire-mesh crates, Euro pallets carrying a load, Euro pallets without a load, and steel-walled boxes thus induce different movement sequences of the mobile part. For example, these load carriers are placed in locations in a stacker store and the mobile part is guided along tracks so that it is able to drive to a position allocated to each location of the stacker store, from where the type of individual load carrier is identifiable with the aid of the radar sensors. Depending on the identified type, different movement sequences are able to be carried out in the further course of time.

According to example embodiments, the mobile part has a track guidance device, which is connected to the control of the mobile part, in particular, a track guidance device, especially a metal wire or metallic cable, is installed on the driving surface in the system. This offers the advantage that the mobile part is able to reach the position allocated to each location by following the track and approaching the allocated position with the aid of a position detection system. From there, the identification is carried out using the radar sensors. In this manner, the location is acquired at all times and detected under the same angle and distance with the aid of the radar sensors.

Further features and aspects of example embodiments of the present invention are described in greater detail below with reference to the appended Figures.

DETAILED DESCRIPTION

Figure 1:
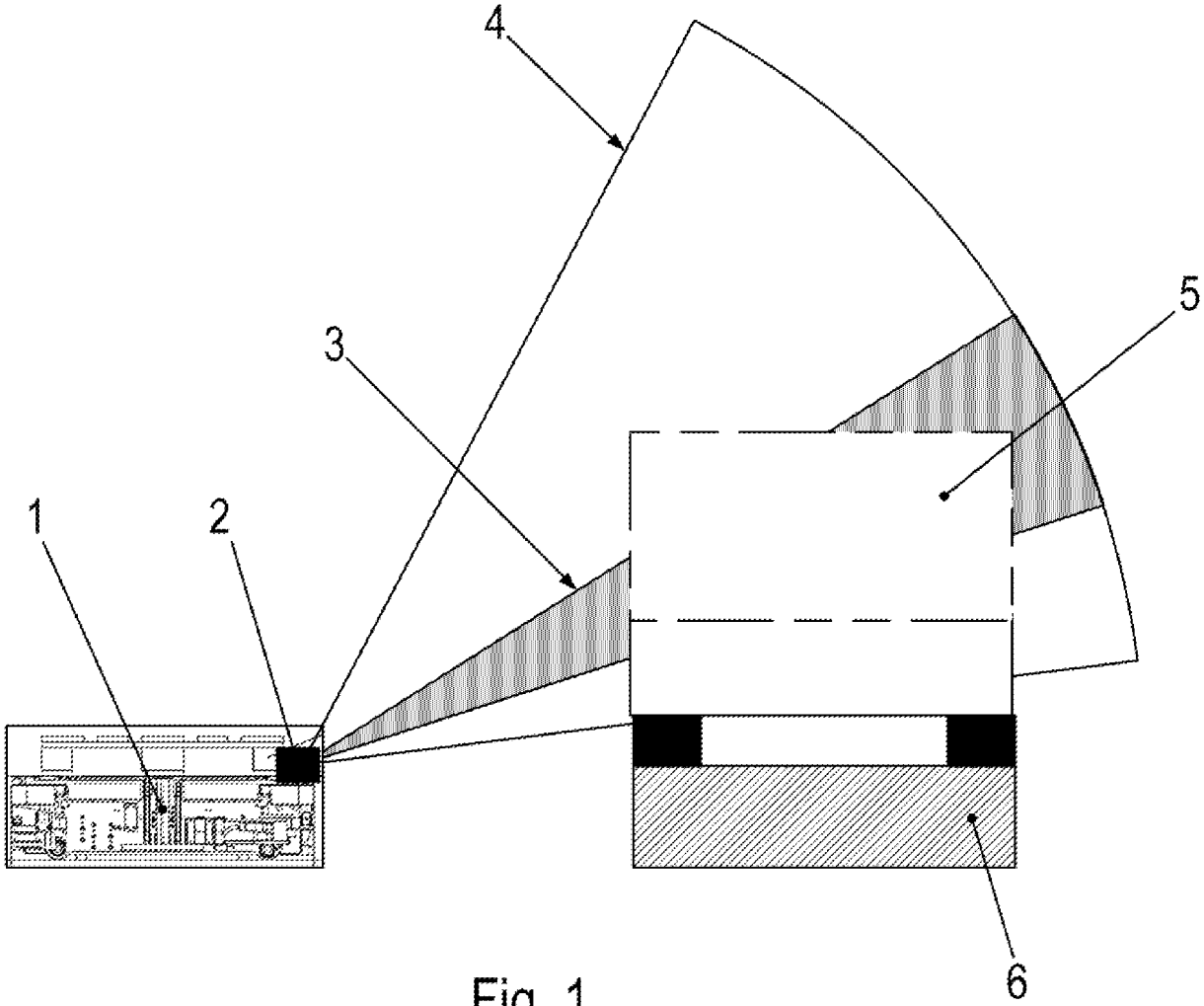
FIG. 1 illustrates a mobile part 1, which has a radar sensor 2 whose sensitive region 4 is directed toward a first load carrier, i.e., a Euro pallet carrying a load.
Figure 2:
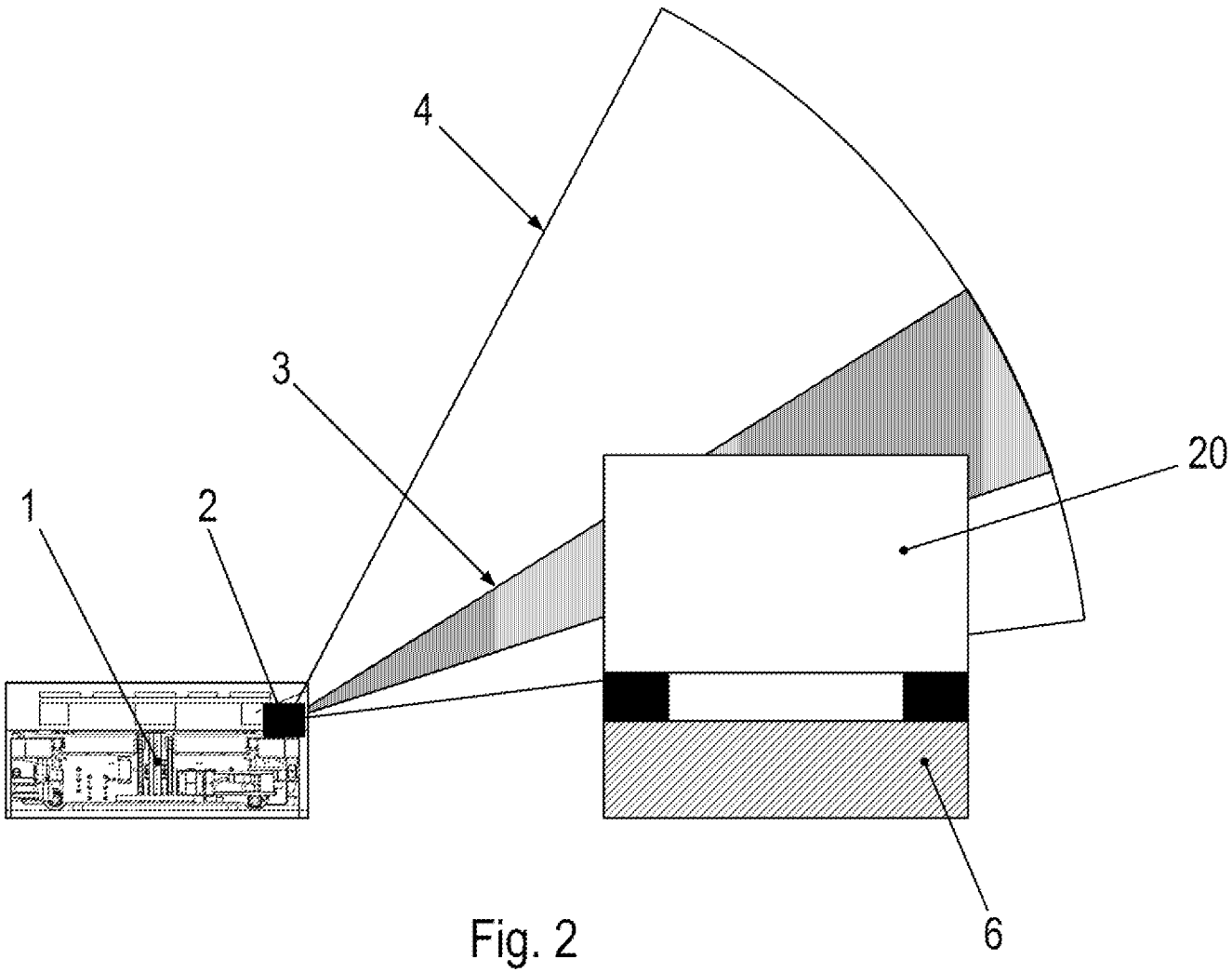
FIG. 2 illustrates mobile part 1 whose sensitive region 4 of radar sensor 2 is directed toward a second load carrier, i.e., a steel-walled box.
Figure 3:
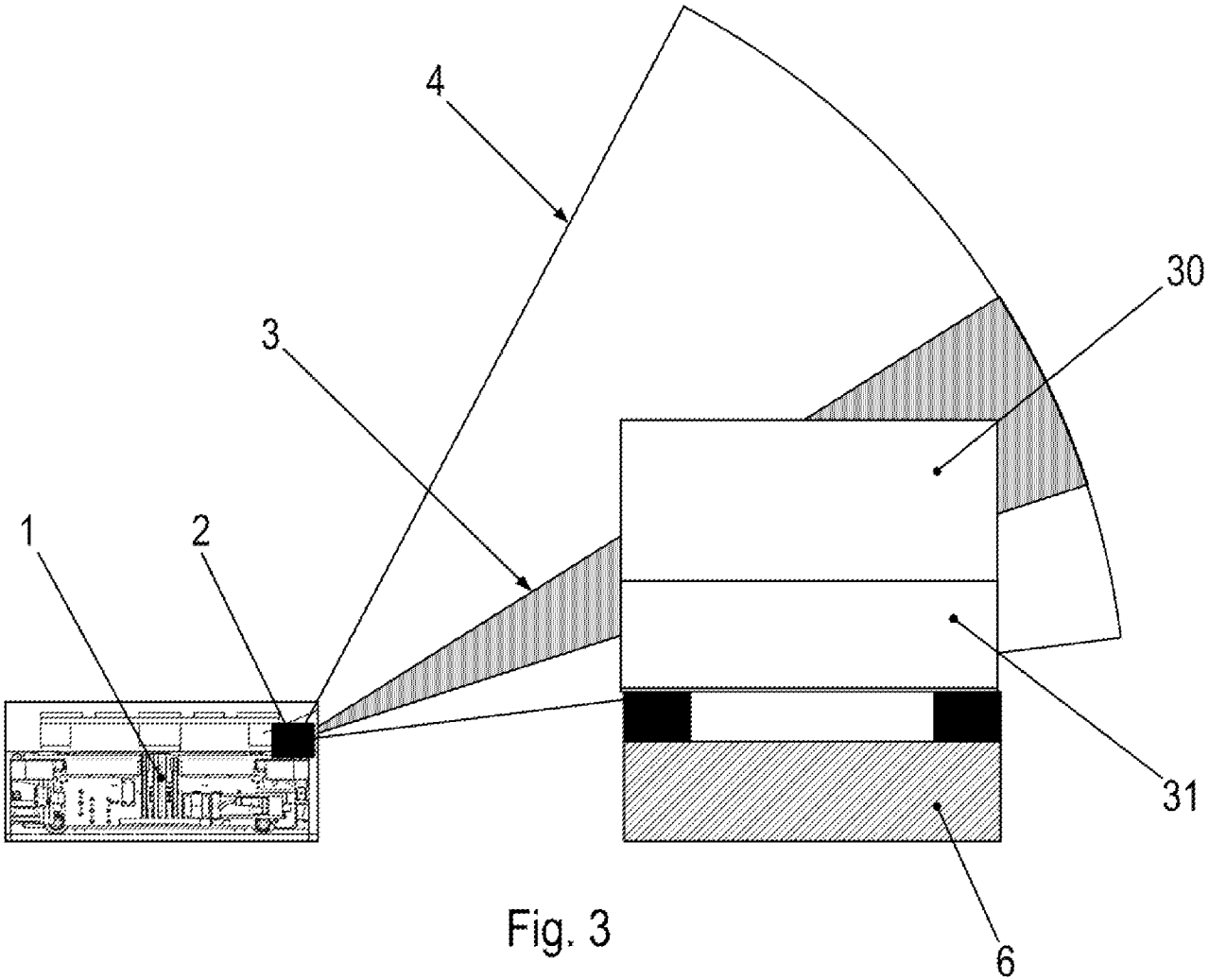
FIG. 3 illustrates mobile part 1 whose sensitive region 4 of radar sensor 2 is directed toward a third load carrier, i.e., wire-mesh crate 31 provided with a movable flap.

As illustrated in the Figures, radar sensor 2 has a sensitive region 4 so that the distance between sensor 2 and objects is able to be determined. An FCMW radar sensor may be used as a sensor for this purpose. As an evaluation of the sensor signal from sensor 2, the transmitted radar signal is mixed with the reflected radar signal received by sensor 2 and an intermediate frequency signal is generated in this manner, which is conveyed to an evaluation unit.

The evaluation unit is situated on mobile part 1 and determines a frequency spectrum of the intermediate frequency signal, e.g., with the aid of a Fourier transform.

The pattern formed by the frequency spectrum is evaluated by a pattern recognition device, which compares the formed pattern with stored patterns, that is to say, pattern samples. As soon as one of the pattern samples is identified, the pattern recognition device conveys this information to a control of the mobile part, which starts further control sequences for mobile part 1 as a function of this information.

A first pattern sample is the stored pattern of the frequency spectrum of a detected wire-mesh crate 31 having a flap 30 which is movably disposed thereon. The wire-mesh crate has a metallic mesh, in particular steel mesh. Because a mesh has open mesh gaps, the first pattern sample differs considerably from the pattern sample of a steel-walled box.

In such a steel-walled box 20, the radar radiation is reflected more strongly in comparison with a wire-mesh crate 31 because steel-walled box 20 has a solid steel wall.

A third pattern sample corresponds to the pattern of the frequency spectrum of a Euro pallet 5 carrying a load. Euro pallet 5 is made from wood and accommodates a load which is, e.g., contained in a cardboard box. As a result, the radar radiation is reflected to a lesser degree by Euro pallet 5 and its accommodated load, in particular a cardboard box, than by steel-walled box 20. In addition, the pattern also differs from the pattern of wire-mesh crate 31, because the wire-mesh gaps of the wire-mesh crate do not constitute a homogeneous surface, especially when compared to the steel wall of the steel-walled box and also in comparison with the side of a cardboard box.

Through a comparison with a further pattern sample, it is possible to detect in the pattern recognition whether the flap disposed on a wire-mesh crate 31, in particular in a manner that allows the flap to slide or fold, is in a first or a second position, or in other words, whether the side wall of wire-mesh crate 31 is closed by the flap or is open, in particular.

Wire-mesh crate 31 is open at the top and thus has a cuboidal form, and the underside is connected to the four side walls and has foot regions on its side facing away from the topside. The topside of the cuboid is provided without material, which is why wire-mesh box 31 is open at the top.

In the same manner, steel-walled box 20 is open at the top and thus has a cuboidal form, with the underside being connected to the four side walls and having foot regions on its side facing away from the topside. The topside of the cuboid is provided without material, which is why steel-walled box 20 is open at the top.

In order to keep errors in the pattern recognition to a minimum, mobile part 1 drives on a driving surface of a system up to a predefined setpoint distance from the load carrier, with the orientation of mobile part 1 with respect to the load carrier being predefined as well, in particular in that mobile part 1 is driving along a track installed in the system. As soon as mobile part 1 has reached the setpoint distance, the intermediate frequency signal of radar sensor 2 is evaluated and the type of load carrier is therefore determined with the aid of the pattern recognition.

Even in a storage facility, it is therefore possible to determine for a respective storage location the type of load carrier it accommodates, or to determine whether a load carrier is accommodated at all.

To keep errors in the pattern recognition to a minimum, only a subregion of sensitive region 4 usable for the distance determination is used for the distance determination, i.e., detection range 3. This range is provided at a fixed angle with respect to the driving surface and at a fixed angle with respect to the mobile part, in particular relative to an axis of a non-steerable wheel of mobile part 1. As a result, the same kind of marginal conditions, if possible, is ensured when carrying out the pattern recognition.

The radar sensor may be operated in the E band, in particular in the ISM band or W band. The resolution amounts to between 1 cm and 10 cm, in particular to 4 cm. As a result, the mesh openings of a wire-mesh crate commonly used in the industry are not precisely resolvable.

The radar sensor may be operated in the ISM band with a bandwidth of 5 GHz.

LIST OF REFERENCE NUMERALS

1 mobile part
2 radar sensor
3 detection range
4 sensitive region
5 Euro pallet carrying a load
6 accommodation device
20 steel-walled box
31 wire-mesh crate
30 movably disposed flap

The invention claimed is:

1. A method for operating a system that includes a mobile part drivable on a driving surface of the system and a load carrier of the system, the mobile part including a radar sensor connected to a control device of the mobile part, comprising:

determining a distance from the radar sensor to the load carrier;

driving the mobile part to a position at which the distance between the radar sensor and the load carrier reaches a predefined setpoint distance;

determining a frequency spectrum of an intermediate frequency signal that is generated by mixing radar radiation emitted by the radar sensor and received radar radiation;

comparing the frequency spectrum to stored pattern symbols;

conveying, to the control device, a result of the comparison; and actuating, by the control device, at least one actuator of the mobile part as a function of the result of the comparison.

2. The method according to claim 1, wherein the load carrier is arranged as a stationary load carrier.

3. The method according to claim 1, wherein the radar radiation emitted by the radar sensor is emitted in a direction of the load carrier, and the received radar radiation is received from the direction of the load carrier.

4. The method according to claim 1, wherein the comparing includes pattern recognition.

5. The method according to claim 1, wherein the comparing includes comparing a pattern formed by the frequency spectrum to the stored pattern samples.

6. The method according to claim 1, wherein the actuator includes a drive and/or steering unit of the mobile part.

7. The method according to claim 1, wherein the control device performs a control sequence as a function of the result of the comparison.

8. The method according to claim 1, wherein the result of the comparison includes a type of load carrier.

9. The method according to claim 1, wherein a first pattern sample is generated from the frequency spectrum of the intermediate frequency signal of the radar sensor during detection of a wire-mesh crate.

10. The method according to claim 9, wherein the wire-mesh crate includes a side wall provided with steel mesh.

11. The method according to claim 10, wherein the steel mesh includes openings having a maximum inner diameter of less than 5 cm.

12. The method according to claim 9, wherein a top of the wire-mesh crate is open.

13. The method according to claim 1, wherein a second pattern sample is generated from the frequency spectrum of the intermediate frequency signal of the radar sensor during detection of a steel-walled box.

14. The method according to claim 13, wherein the steel-walled box includes a side wall of solid steel.

15. The method according to claim 13, wherein a top of the steel-walled box is open.

16. The method according to claim 1, wherein a third pattern sample is generated from the frequency spectrum of the intermediate frequency signal of the radar sensor during detection of a Euro pallet carrying a load.

17. The method according to claim 16, wherein the Euro pallet is made of wood and the load includes a cardboard box.

18. The method according to claim 1, wherein a fourth pattern sample is generated from the frequency spectrum of the intermediate frequency signal of the radar sensor during detection of a Euro pallet without a load.

19. The method according to claim 18, wherein the Euro pallet is made of wood.

20. The method according to claim 1, wherein:

(a) a first pattern sample is generated from the frequency spectrum of the intermediate frequency signal of the radar sensor during detection of a wire-mesh crate;

(b) a second pattern sample is generated from the frequency spectrum of the intermediate frequency signal of the radar sensor during detection of a steel-walled box;

(c) a third pattern sample is generated from the frequency spectrum of the intermediate frequency signal of the radar sensor during detection of a Euro pallet carrying a load; and (d) a fourth pattern sample is generated from the frequency spectrum of the intermediate frequency signal of the radar sensor during detection of a Euro pallet without a load.

21. A system, comprising:

a mobile part adapted to be driven on a driving surface of the system and including a control device, an electric drive controllable by the control device, and a controllable steering unit;

a load carrier adapted to be arranged on the driving surface;

a radar sensor provided on the mobile part, connected to the control device, and adapted for signal transmission;

wherein the control device is adapted to control the drive and the steering unit as a function of signals from the radar sensor; and wherein the system is adapted to perform the method recited in claim 9.

22. The system according to claim 21, wherein the mobile part includes a track guidance device connected to the control device.

23. The system according to claim 22, wherein the track guidance device includes a metal wire and/or a metallic cable adapted to be installed on the driving surface.

* * * * *